US006259212B1

(12) United States Patent
Song

(10) Patent No.: US 6,259,212 B1
(45) Date of Patent: Jul. 10, 2001

(54) PLASMA DISPLAY PANEL

(75) Inventor: Man-ho Song, Cheonan (KR)

(73) Assignee: Samsung SDI Co., Ltd., Kyungki-Do (KR)

( * ) Notice: Subject to any disclaimer, the term of this patent is extended or adjusted under 35 U.S.C. 154(b) by 0 days.

(21) Appl. No.: 09/593,475

(22) Filed: Jun. 14, 2000

(30) Foreign Application Priority Data

Jul. 9, 1999 (KR) ..... 99-27766

(51) Int. Cl.[7] ..... G09G 3/10

(52) U.S. Cl. ..... 315/169.4; 315/169.1; 313/582; 313/586; 313/587; 345/72; 345/77; 345/68

(58) Field of Search ..... 315/169.4, 169.1; 313/485, 486, 489, 582, 586, 587, 585; 345/41, 60, 68, 72, 77

(56) References Cited

U.S. PATENT DOCUMENTS

| | | | | |
|---|---|---|---|---|
| 5,541,479 | | 7/1996 | Nagakubo | 313/586 |
| 6,008,582 | | 12/1999 | Asano et al. | 313/586 |
| 6,034,474 | * | 3/2000 | Ueoka et al. | 313/584 |
| 6,137,226 | * | 10/2000 | Nagano | 313/582 |
| 6,184,848 | * | 2/2001 | Weber | 345/60 |
| 6,184,849 | * | 2/2001 | Stoller | 345/72 |

FOREIGN PATENT DOCUMENTS

| | | |
|---|---|---|
| 0 712 148 | 5/1996 | (EP) . |
| 10-188820 | 7/1998 | (JP) . |
| 10-208645 | 8/1998 | (JP) . |

* cited by examiner

*Primary Examiner*—Haissa Philogene
(74) *Attorney, Agent, or Firm*—Leydig, Voit & Mayer, Ltd.

(57) ABSTRACT

A plasma display panel includes front and rear substrates facing each other, common and scanning electrodes on the bottom surface of the front substrate, spaced apart from and parallel to each other, a first dielectric layer on the bottom surface of the front substrate embedding the common and scanning electrodes, address electrodes on the rear substrate orthogonal to the common and scanning electrodes, a second dielectric layer on the top surface of the rear substrate embedding the address electrodes, partition walls defining discharge spaces, each partition wall including a white partition wall on the top surface of the second dielectric layer, and an auxiliary partition wall on the top surface of the white partition wall and reflecting only light in a wavelength range of 420–550 nanometers, and red, green, and blue light-producing phosphor layers on the second dielectric layer and between the partition walls.

3 Claims, 2 Drawing Sheets

PLASMA DISPLAY PANEL

BACKGROUND OF THE INVENTION

1. Field of the Invention

The present invention relates to a plasma display panel in which the structure of a partition wall formed on a rear substrate is improved.

2. Description of the Related Art

A plasma display panel (PDP) usually produces a discharge in a gas that is hermetically sealed between two substrates having electrodes, which generates ultraviolet rays. The ultraviolet rays excite phosphors, thereby displaying a desired image.

FIG. 1 shows a conventional PDP. Referring to FIG. 1, a front substrate 11 and a rear substrate 12 are located opposite to each other. Common electrodes 13 and scanning electrodes 14 alternate on the bottom surface of the front substrate 11 in a striped pattern. Bus electrodes 15 may be formed on the common and scanning electrodes 13 and 14 to reduce line resistance. A dielectric layer 16 on the bottom surface of the front substrate 11 embeds the common and scanning electrodes 13 and 14. A protective layer 17, for example, a MgO layer, may be formed on the dielectric layer 16.

Address electrodes 18 are formed on the rear substrate 12 crossing the common and scanning electrodes 13 and 14. The address electrodes 18 are embedded in a dielectric layer 19 with which the rear substrate 12 is coated. Partition walls 100 on the dielectric layer 19 are parallel to the address electrodes 18 in a striped pattern. Portions between the partition walls 100 are coated with phosphor layers 110 producing red, green and blue light.

The partition walls 100 may have various shapes. Each partition wall 100 is composed of a transparent white partition wall 100*a* having a predetermined height from the top of the dielectric layer 19 and a black partition wall 100*b* on the white partition wall 100*a*. The white partition wall 100*a* is provided to act as a reflector so as to improve the luminance efficiency of the phosphor layer 110 during discharge. The black partition wall 100*b* has a predetermined thickness so as to function as a black matrix.

In the conventional PDP having the above structure, once a voltage is applied between the scanning electrodes 14 and the address electrodes 18, pre-discharge occurs and wall charges are produced in the discharge space. In this state, when a voltage is applied between the common electrodes 13 and the scanning electrodes 14, a glow discharge occurs, thereby changing the gas into a plasma. Ultraviolet rays are emitted from the plasma and excite the phosphor layers 110, thereby displaying an image.

The phosphor layers 110 producing red, green and blue light are on the dielectric layer 19 and between the partition walls 100. In the conventional PDP 10, the light produced by the blue phosphor layers is relatively lower in luminance than the light produced by the red and green phosphor layers. To compensate for the low luminance from the blue phosphor layer, various methods have been developed. One method is to provide a blue phosphor layer that is wider than a red phosphor layer and a blue phosphor layer. Another method is to increase the luminance of a blue phosphor layer using an additional blue filter.

However, when enlarging the area of a blue phosphor layer to be wider than the area of a red phosphor layer and the area of a green phosphor layer, the size of a discharge cell defined by a pair of common and scanning electrodes 13 and 14, in which a sustain discharge occurs, is not uniform. Moreover, when an additional blue filter is used for improving the luminance of a blue phosphor layer, the structure of the PDP 10 becomes complicated.

SUMMARY OF THE INVENTION

To solve the above problem, an object of the present invention is to provide a plasma display panel (PDP) in which the structure of a partition wall is improved to increase the luminance of a blue phosphor layer.

To achieve the above object, the present invention provides a plasma display panel including front and rear substrates provided to face each other; common and scanning electrodes formed on the bottom surface of the front substrate to be spaced apart from and parallel to each other; a first dielectric layer formed on the bottom surface of the front substrate such that the common and scanning electrodes are embedded in the first dielectric layer; address electrodes formed on the rear substrate to be orthogonal to the common and scanning electrodes; a second dielectric layer formed on the top surface of the rear substrate such that the address electrodes are embedded in the second dielectric layer; partition walls for defining discharge spaces, each partition wall comprising a white partition wall formed on the top surface of the second dielectric layer and an auxiliary partition wall formed on the top surface of the white partition wall, the auxiliary partition wall selectively reflecting only light of a wavelength of 420–550 nanometers among visible rays; and red, green and blue phosphor layers formed on the second dielectric layer and between the partition walls.

The auxiliary partition wall is blue and mainly formed of a glass material having a low melting point and containing cobalt aluminum oxide ($CoAl_2O_4$).

BRIEF DESCRIPTION OF THE DRAWINGS

The above object and advantage of the present invention will become more apparent by describing in detail a preferred embodiment thereof with reference to the attached drawings in which.

DETAILED DESCRIPTION OF THE INVENTION

Figure 1:
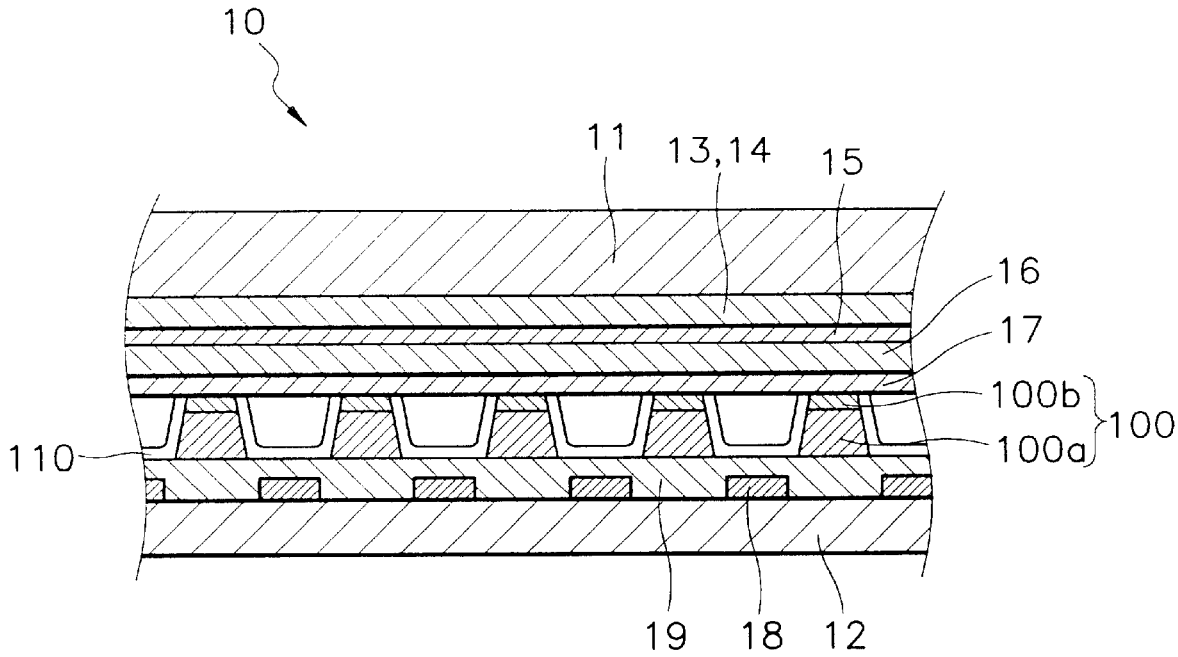
FIG. 1 (PRIOR ART)
FIG. 1 is a sectional view of a conventional plasma display panel (PDP)
Figure 2:
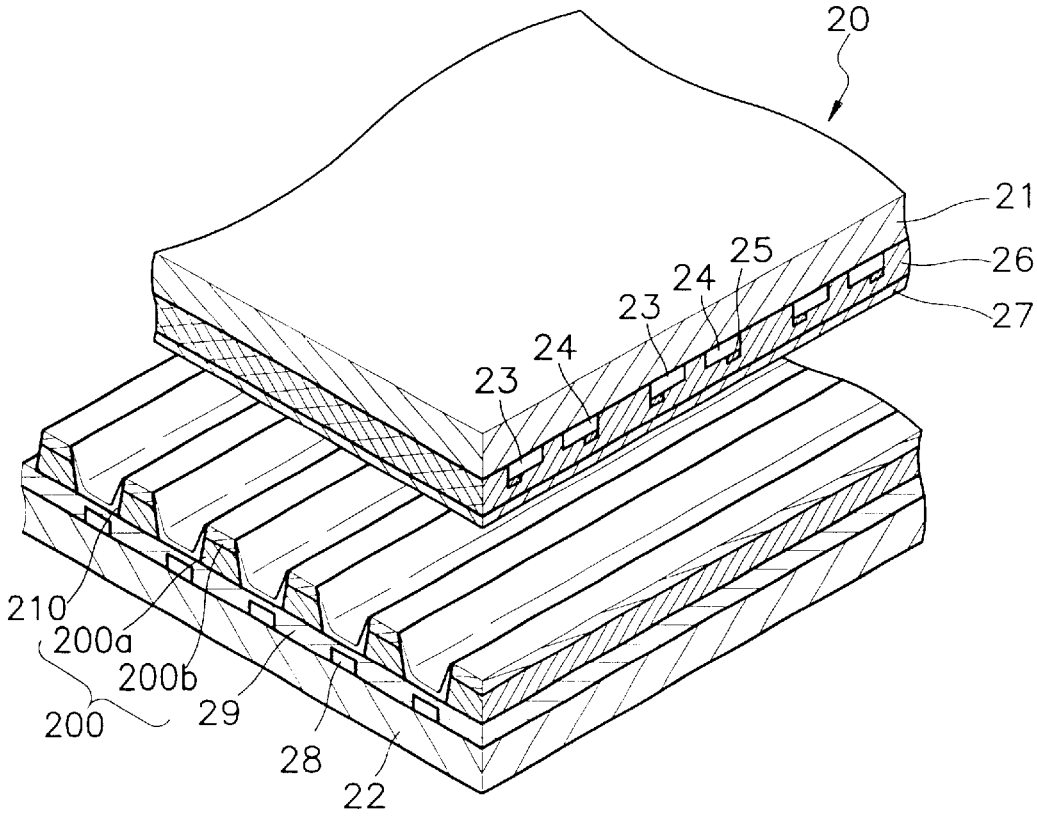
FIG. 2 is a partially exploded, perspective view of a PDP according to an embodiment of the present invention.

Referring to FIG. 2, a plasma display panel (PDP) 20 includes a front substrate 21 and a rear substrate 22. Common electrodes 23 and scanning electrodes 24 alternate the bottom surface of the front substrate 21 in a striped pattern. Bus electrodes 25 are formed on the bottom surfaces of the common and scanning electrodes 23 and 24 to reduce line resistance. Each bus electrode 25 is a metal material narrower than the common or scanning electrode 23 or 24. A transparent first dielectric layer 26 on the bottom surface of the front substrate 21 embeds the common and scanning electrodes 23 and 24 and the bus electrodes 25. A protective layer 27, for example, a MgO layer, is formed on the bottom surface of the first dielectric layer 26 to protect the first dielectric layer 26.

Address electrodes 28 on the rear substrate 22 face the front substrate 21 and are orthogonal to the common and scanning electrodes 23 and 24 in a striped pattern. The address electrodes 28 may be embedded in a second dielectric layer 29.

Partition walls 200 on the second dielectric layer 29 are spaced apart a predetermined distance to define discharge spaces and create cross-talk between electrodes. Red, green and blue light-producing phosphor layers 210 are located between the partition walls 200.

Each partition wall 200 is composed of a transparent white partition wall 200*a* having a predetermined height from the top of the second dielectric layer 29 and a blue auxiliary partition wall 200*b* on the white partition wall 200*a*.

The white partition wall 200*a* functions as a reflector to improve the luminance efficiency of the phosphor layer 210 during discharge, thereby increasing the overall luminance. The auxiliary partition wall 200*b* is a blue partition wall to selectively reflect only light of a particular wavelength range, for example, a wavelength of 420–550 nanometers, among visible light produced in the discharge space between the partition walls 200, thereby increasing only the luminance of a blue color in the PDP 20.

The following fabrication steps are performed to form the partition walls 200 in the PDP 20 having the above structure according to the present invention. First, the rear substrate 22 of glass is prepared. An ITO layer is formed on the top surface of the rear substrate 22 by sputtering patterned to form the address electrodes 28 in a striped pattern. Next, the dielectric layer 29 is deposited on the entire surface of the rear substrate 22 such that the address electrodes 28 are embedded in the dielectric layer 29.

Subsequently, a screen having the same pattern as that of the white partition walls 200*a* spaced apart a predetermined distance is stuck fast to the top surface of the dielectric layer 29. In this state, the source material of the white partition walls 200*a* is printed and then dried and fired thereby forming the white partition walls 200*a*. Thereafter, a blue screen having the same pattern as that of the auxiliary partition walls 200*b* is stuck fast to the top surfaces of the white partition walls 200*a*. Then, the same steps as performed when forming the white partition walls 200*a* are performed to form the blue auxiliary partition walls 200*b*. Next, the red, green and blue light-producing phosphor layers 210 are formed between the partition walls 200.

To form the blue auxiliary partition wall 200*b*, for example, a glass material having a low melting point containing cobalt aluminum oxide ($CoAl_2O_4$) is used. The glass material is mixed with adhesives, a solvent and a dispensing agent and agitated for several hours, thereby making pigment paste.

A color layer is printed using the screen for forming the auxiliary partition walls 200*b* and fired at a proper temperature to remove organic matter and solvent contained in the source material of the auxiliary partition walls 200*b*. Finally, the auxiliary partition walls 200*b* are completed.

As described above, in a PDP of the present invention, a partition wall on a rear substrate is composed of a white partition wall and an auxiliary partition wall on the white partition wall to reflect only light of a particular wavelength range. The white partition wall functions as a reflector for improving the luminance efficiency of a phosphor layer during discharge, thereby increasing the overall luminance of the PDP. The auxiliary partition wall selectively reflects only the blue light among visible light produced between partition walls, thereby increasing the luminance of blue color. Therefore, the present invention solves the problem of a light from blue phosphor layer being lower in luminance than light from a red phosphor layer and light from a green phosphor layer in the conventional PDP.

While this invention has been particularly shown and described with references to a preferred embodiment thereof, it will be understood by those skilled in the art that various changes in form and details may be made therein without departing from the spirit and scope of the invention as defined by the appended claims.

What is claimed is:

1. A plasma display panel comprising:

front and rear substrates facing each other;

common and scanning electrodes on a bottom surface of the front substrate spaced apart from and parallel to each other;

a first dielectric layer on the bottom surface of the front substrate embedding the common and scanning electrodes;

address electrodes on the rear substrate orthogonal to the common and scanning electrodes;

a second dielectric layer on a top surface of the rear substrate embedding the address electrodes;

partition walls defining discharge spaces, each partition wall comprising a white partition wall on a top surface of the second dielectric layer and an auxiliary partition wall on a top surface of the white partition wall, the auxiliary partition wall selectively reflecting only light having wavelengths in a range 420–550 nanometers; and phosphor layers respectively producing red, green and blue light on the second dielectric layer and between the partition walls.

2. The plasma display panel of claim 1, wherein the auxiliary partition wall is blue.

3. The plasma display panel of claim 2, wherein the auxiliary partition wall includes a glass material having a low melting point and containing cobalt aluminum oxide ($CoAl_2O_4$).

* * * * *